US007085617B2

(12) United States Patent
Kaiya et al.

(10) Patent No.: US 7,085,617 B2
(45) Date of Patent: Aug. 1, 2006

(54) CONTROL UNIT FOR CONTROLLING EMBROIDERY SEWING MACHINE

(75) Inventors: Akira Kaiya, Nagoya (JP); Tsuneo Okuyama, Inabe-gun (JP); Takafumi Naka, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/151,232

(22) Filed: Jun. 14, 2005

(65) Prior Publication Data

US 2006/0021559 A1 Feb. 2, 2006

(30) Foreign Application Priority Data

Jul. 28, 2004 (JP) ..... 2004-219919

(51) Int. Cl.
*D05C 5/02* (2006.01)

(52) U.S. Cl. ..... 700/138; 112/475.19

(58) Field of Classification Search ..... 700/138; 112/102.5, 470.06, 300, 475.19
See application file for complete search history.

(56) References Cited

U.S. PATENT DOCUMENTS 5,560,306 A * 10/1996 Kyuno et al. ..... 112/102.5
5,865,134 A * 2/1999 Okuyama et al. ..... 112/102.5
6,123,037 A * 9/2000 Shimizu ..... 112/102.5

FOREIGN PATENT DOCUMENTS

JP A-10-137477 5/1998

* cited by examiner

*Primary Examiner*—Danny Worrell
(74) *Attorney, Agent, or Firm*—Oliff & Berridge, PLC

(57) ABSTRACT

A control unit for controlling an embroidery sewing machine includes an embroidery-data storing portion, a feed-data extracting portion, and a thread-cutting-data adding portion. The embroidery-data storing portion stores embroidery data defining an embroidery pattern sewn by a sewing portion and a workpiece feeding portion. The embroidery data includes stitch data indicating needle drop positions for forming stitches on a workpiece and feed data indicating feed positions for feeding the workpiece. The feed-data extracting portion extracts the feed data from the embroidery data read from the embroidery-data storing portion. The thread-cutting-data adding portion adds thread cutting data immediately prior to the feed data extracted by the feed-data extracting portion. The thread cutting data instructs a thread cutting portion to perform thread cutting.

36 Claims, 9 Drawing Sheets

CONTROL UNIT FOR CONTROLLING EMBROIDERY SEWING MACHINE

CROSS-REFERENCE TO RELATED APPLICATION

This application claims priority from Japanese Patent Application No. 2004-219919, filed Jul. 28, 2004, the disclosure of which is incorporated herein in its entirety by reference thereto.

BACKGROUND

The present disclosure relates to a control unit for an embroidery sewing machine, and particularly to a control unit capable of sewing a plurality of separate embroidery regions based on embroidery data that includes a plurality of stitch data for specifying needle drop positions and feed data or feed stitch data for feeding a workpiece.

Conventionally, a household electronic sewing machine capable of embroidery sewing can perform sewing of utility patterns such as zigzag stitch, straight stitch, decorative stitch, and the like. The sewing machine can also be detachably mounted with an embroidery frame drive mechanism on a bed section, and can perform embroidery sewing using the embroidery frame drive mechanism. That is, the sewing machine can perform sewing of the utility patterns by driving a needle bar vertically and swinging the needle bar in the left-right direction while moving a workpiece (fabric) in the front-rear and left-right directions with a feed dog disposed in the bed section, without using the embroidery frame drive mechanism. The sewing machine can also perform sewing of embroidery patterns (so-called embroidery sewing) by mounting the embroidery frame drive mechanism on the bed section of the sewing machine and by driving the needle bar vertically while driving the embroidery frame drive mechanism to move the embroidery frame based on embroidery data specifying a desired embroidery pattern, thereby forming the desired embroidery pattern on the workpiece held in the embroidery frame.

Embroidery sewing machines that hold a fabric with an embroidery frame and form stitches while moving the embroidery frame in two directions orthogonal to one another are well known in the art. Recent embroidery sewing machines allow a user to select a desired embroidery pattern from a plurality of patterns and are capable of sewing the embroidery pattern based on corresponding embroidery data stored in memory.

One such sewing machine disclosed in Japanese patent-application publication No. HEI-10-137477 includes a bed section and a thread trimmer disposed in the bed section. When sewing a plurality of embroidery regions sequentially while changing the color of thread used in each region, the sewing machine is provided with thread cutting data at the end of the embroidery data for each embroidery region, enabling the sewing machine to cut the thread after completing each region.

By providing thread cutting data at the end of the embroidery data for each region, this type of embroidery sewing machine can cut the thread after completing each embroidery region so that unsightly lines of thread connecting separate embroidery regions (i.e., jump stitch) are not left when regions are sewn with the same color of thread. As a result, the operator of the sewing machine need not manually cut the jump stitch between embroidery regions after the sewing is completed, thereby requiring less time to perform the sewing operation.

SUMMARY

However, even when the bed section of these conventional embroidery sewing machines accommodates a thread trimmer, the machines are not equipped with a wiper for wiping the upper thread after the thread is cut. As a result, these embroidery sewing machines are incapable of cutting embroidery thread during a process of embroidering a plurality of regions with the same color of thread. Hence, embroidery data for such regions do not include thread cutting commands.

Therefore, conventional embroidery sewing machines are designed to use feed data to bypass a previously-sewn embroidery region that has already been sewn when sewing separate regions with the same color of thread so that stitches do not interfere with the previously-sewn embroidery region.

Accordingly, conventional embroidery data includes feed data as well as stitch data that are provided for embroidery regions using the same color of thread, but the embroidery data does not include thread cutting commands.

Textile factories that have been doing business for many years generally possess embroidery data for numerous patterns, but this data does not include thread cutting commands. Even if the factory purchases new embroidery sewing machines equipped with thread trimmers and wipers, without such thread cutting commands, thread cannot be cut during an embroidery sewing process when needed. Therefore, workers must perform an additional operation to cut jump stitches after a plurality of embroidery regions using the same color of thread is sewn in succession, reducing work efficiency in sewing operations.

It is conceivable that this outdated embroidery data that includes no thread cutting commands may be edited to insert thread cutting commands where appropriate, or new embroidery data including thread cutting commands may be purchased. However, editing or purchasing embroidery data having a plurality of embroidery regions using a plurality of thread colors is very expensive and requires a major investment. Further, embroidery data currently on hand cannot be effectively utilized.

In view of the foregoing, it is an object of the present disclosure to provide a control unit for an embroidery sewing machine that is capable of controlling sewing operations for a plurality of separate embroidery regions, while eliminating jump stitches between the embroidery regions by forcibly cutting the thread after each region is sewn.

In order to attain the above and other objects, according to one aspect, the present disclosure provides a control unit for controlling an embroidery sewing machine including a sewing portion, a workpiece feeding portion, and a thread cutting portion. The control unit includes an embroidery-data storing portion, a feed-data extracting portion, and a thread-cutting-data adding portion. The embroidery-data storing portion stores embroidery data defining an embroidery pattern sewn by the sewing portion and the workpiece feeding portion. The embroidery data includes stitch data indicating needle drop positions for forming stitches on a workpiece and feed data indicating feed positions for feeding the workpiece. The feed-data extracting portion extracts the feed data from the embroidery data read from the embroidery-data storing portion. The thread-cutting-data adding portion adds thread cutting data immediately prior to the feed data extracted by the feed-data extracting portion. The thread cutting data instructs the thread cutting portion to perform thread cutting.

According to another aspect, the present disclosure provides a control unit for controlling an embroidery sewing machine including a sewn portion, a workpiece feeding portion, and a thread cutting portion. The control unit includes an embroidery-data storing portion, a feed-stitch-data extracting portion, and a thread-cutting-data adding portion. The embroidery-data storing portion stores embroidery data defining an embroidery pattern sewn by the sewing portion and the workpiece feeding portion. The embroidery data includes stitch data indicating needle drop positions for forming stitches on a workpiece. The stitch data includes feed stitch data having a stitch length longer than a predetermined length and includes stitch-forming stitch data having a stitch length shorter than or equal to the predetermined length. The feed-stitch-data extracting portion extracts the feed stitch data from the embroidery data read from the embroidery-data storing portion. The thread-cutting-data adding portion adds thread cutting data immediately prior to the feed stitch data extracted by the feed-stitch-data extracting portion. The thread cutting data instructs the thread cutting portion to perform thread cutting.

According to another aspect, the present disclosure provides a control unit for controlling an embroidery sewing machine including a sewing portion, a workpiece feeding portion, and a thread cutting portion. The control unit includes a memory and a controller. The memory stores embroidery data defining an embroidery pattern sewn by the sewing portion and the workpiece feeding portion. The embroidery data includes stitch data indicating needle drop positions for forming stitches on a workpiece and feed data indicating feed positions for feeding the workpiece. The controller extracts the feed data from the embroidery data read from the memory, and adds thread cutting data immediately prior to the feed data. The thread cutting data instructs the thread cutting portion to perform thread cutting.

According to another aspect, the present disclosure provides a control unit for controlling an embroidery sewing machine including a sewing portion, a workpiece feeding portion, and a thread cutting portion. The control unit includes a memory and a controller. The memory stores embroidery data defining an embroidery pattern sewn by the sewing portion and the workpiece feeding portion. The embroidery data includes stitch data indicating needle drop positions for forming stitches on a workpiece. The stitch data includes feed stitch data having a stitch length longer than a predetermined length and includes stitch-forming stitch data having a stitch length shorter than or equal to the predetermined length. The controller extracts the feed stitch data from the embroidery data read from the memory, and adds thread cutting data immediately prior to the feed stitch data. The thread cutting data instructs the thread cutting portion to perform thread cutting.

According to another aspect, the present disclosure provides a method for controlling an embroidery sewing machine including a sewing portion, a workpiece feeding portion, a thread cutting portion, and a memory that stores embroidery data including stitch data and feed data. The method includes extracting the feed data from the embroidery data read from the memory. The embroidery data defines an embroidery pattern sewn by the sewing portion and the workpiece feeding portion. The stitch data indicates needle drop positions for forming stitches on a workpiece. The feed data indicates feed positions for feeding the workpiece. The method further includes adding thread cutting data immediately prior to the feed data extracted in the feed-data extracting step. The thread cutting data instructs the thread cutting portion to perform thread cutting.

According to another aspect, the present disclosure provides a method for controlling an embroidery sewing machine including a sewing portion, a workpiece feeding portion, a thread cutting portion, and a memory that stores embroidery data including stitch data. The stitch data includes feed stitch data and stitch-forming stitch data. The method includes extracting the feed stitch data from the embroidery data read from the memory. The embroidery data defines an embroidery pattern sewn by the sewing portion and the workpiece feeding portion. The stitch data indicates needle drop positions for forming stitches on a workpiece. The feed stitch data has a stitch length longer than a predetermined length. The stitch-forming stitch data has a stitch length shorter than or equal to the predetermined length. The method further includes adding thread cutting data immediately prior to the feed stitch data extracted in the feed-stitch-data extracting step. The thread cutting data instructs the thread cutting portion to perform thread cutting.

BRIEF DESCRIPTION OF THE DRAWINGS

The above and other objects, features and advantages of the disclosure will become more apparent from reading the following description of the exemplary embodiments taken in connection with the accompanying drawings in which.

DETAILED DESCRIPTION OF EMBODIMENTS

Figure 1:
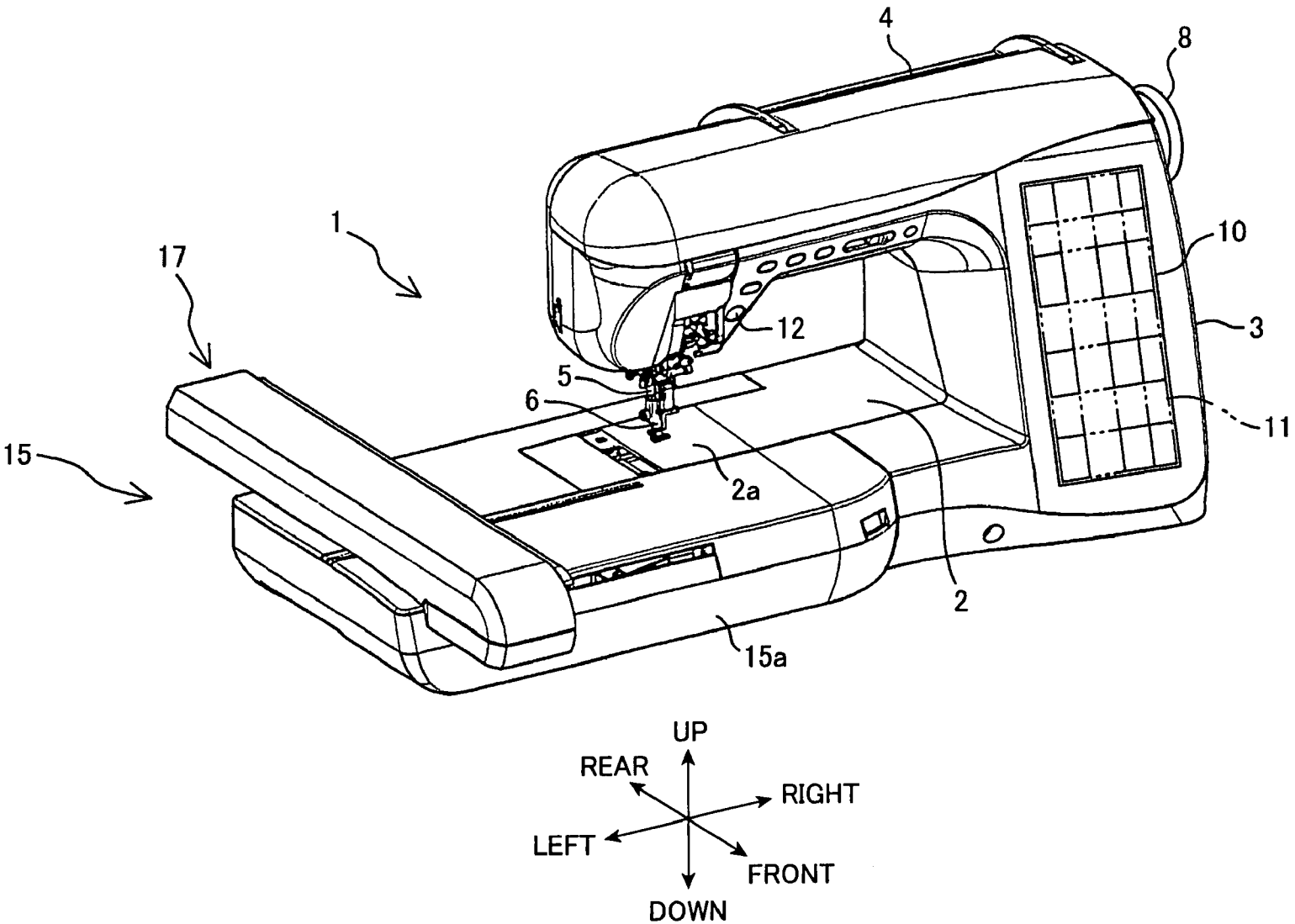
FIG. 1 is a perspective view showing an embroidery sewing machine according to an embodiment of the present disclosure.

A control unit of an embroidery sewing machine according to an embodiment of the present disclosure will be described while referring to the accompanying drawings.

First, an embroidery sewing machine 1 capable of embroidery sewing will be described with reference to FIG. 1. The embroidery sewing machine 1 is similar to electronic-control sewing machines used in the average household and includes a sewing bed 2, a pillar 3 erected from the right end of the sewing bed 2, and an arm 4 extending leftward from the top end of the pillar 3 so as to confront the sewing bed 2.

The sewing bed 2 includes a needle plate 2*a*. Under the needle plate 2*a* are provided a vertical feed dog moving mechanism (not shown) for moving a feed dog up and down; a horizontal feed dog moving mechanism (not shown) for moving the feed dog forward and rearward, as will be described later; a rotary hook (not shown) accommodating a bobbin on which thread is wound and operating in conjunction with a needle 6; a thread trimmer 7 (FIG. 2) described later; and the like.

A large color liquid crystal display (hereinafter simply referred to as "color display") 10 is provided on the front surface of the pillar 3 for displaying various stitch patterns, such as utility patterns and embroidery patterns; function names for executing various functions required in sewing operations; various messages; and the like.

A control panel having touch keys 11 formed on transparent electrodes is disposed on the front surface of the color display 10. The touch keys 11 are arranged in a matrix configuration at positions corresponding to the displayed positions of the pattern names for the utility patterns and embroidery patterns, the function names for executing the various functions, and numerical settings and the like in various screens for setting feed lengths, stitch widths, and the like. Accordingly, a user can select desired embroidery patterns, specify functions, and enter numerical values used for sewing operations by pressing the touch keys 11 corresponding to the desired embroidery patterns or other items displayed in the setting screen.

The arm 4 includes a main drive shaft (not shown) extending in the left-and-right direction in FIG. 1 and driven to rotate by a sewing machine motor 42 (FIG. 3); a hand pulley 8 allowing an operator to manually rotate the main drive shaft; a needle bar 5 on the bottom of which the needle 6 is mounted; a needle bar drive mechanism (not shown) for moving the needle bar 5 vertically; a needle bar swinging mechanism (not shown) for swinging the needle bar 5 in a direction orthogonal to the feed direction; a thread take-up drive mechanism (not shown) for driving a thread take-up up and down in synchronization with the vertical movement of the needle bar 5.

A start/stop switch 12 and the like are provided on the side surface near the front of the arm 4 for starting and stopping sewing operations. A wiper mechanism is provided in the top section of the arm 4 for driving the wiper to wipe thread that has been cut. However, a detailed description of the wiper mechanism is not included herein.

Figure 3:
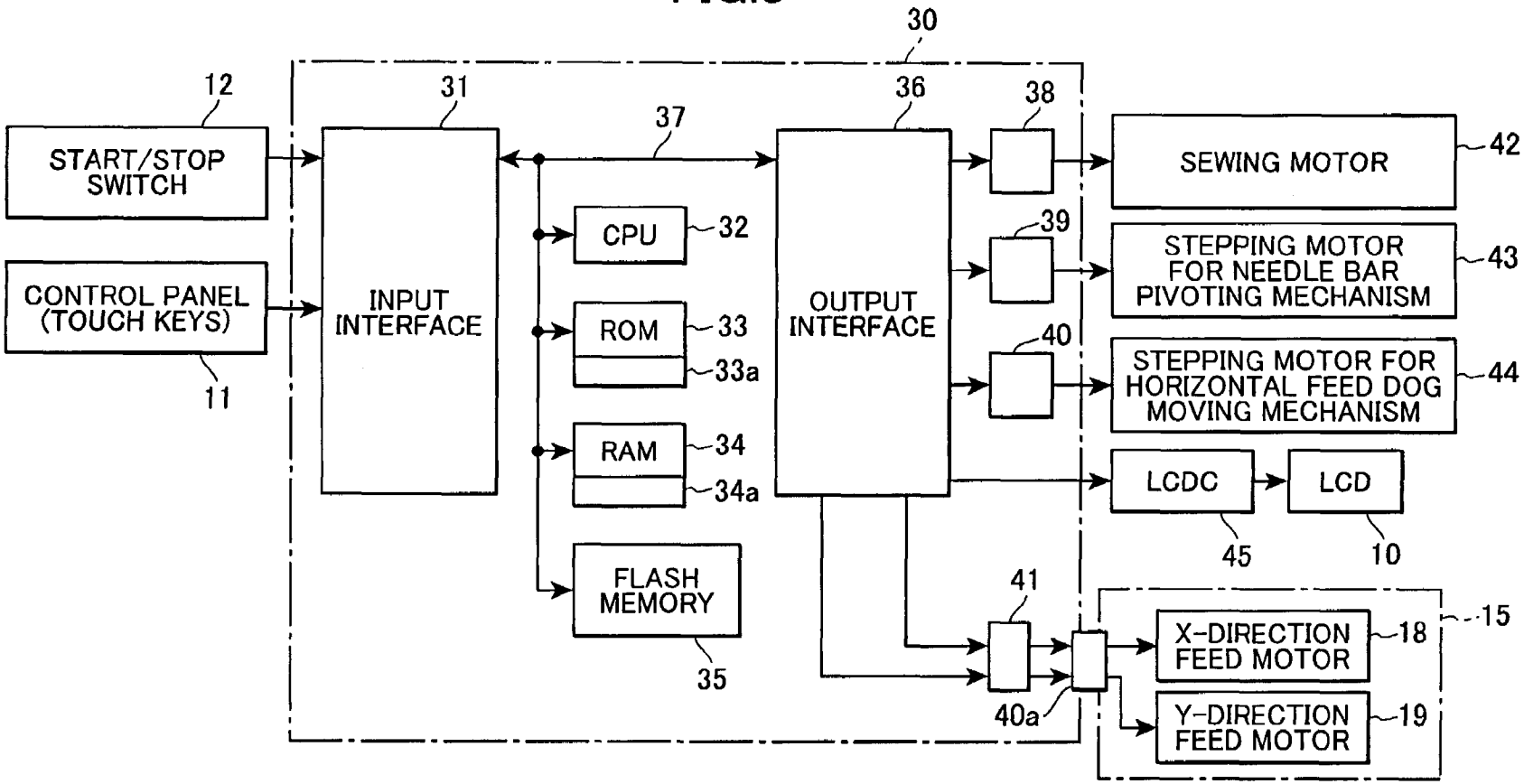
FIG. 3 is a block diagram showing a control system of the embroidery sewing machine according to the embodiment.

The vertical feed dog moving mechanism and the needle bar drive mechanism are driven by the main drive shaft, which in turn is rotated by the sewing machine motor 42. However, the needle bar pivoting mechanism is driven independently by a stepping motor 43, and the horizontal feed dog moving mechanism is driven independently by a stepping motor 44 (FIG. 3).

An embroidery frame drive mechanism 15 is detachably mounted on the left end of the sewing bed 2 for moving an embroidery frame (not shown). The embroidery frame drive mechanism 15 can independently drive the embroidery frame in an X-direction (left-and-right direction) and a Y-direction (front-and-rear direction).

To achieve this, the embroidery frame drive mechanism 15 is provided with a Y-direction drive unit 17 having a built-in Y-direction drive mechanism for moving the embroidery frame in the Y-direction; an X-direction drive mechanism for moving the embroidery frame in the X-direction; an X-direction feed motor 18 (FIG. 3) for driving the X-direction drive mechanism; and a Y-direction feed motor 19 (FIG. 3) for driving the Y-direction drive mechanism.

When the embroidery frame drive mechanism 15 is mounted on the left side of the sewing bed 2, a mode of the embroidery sewing machine 1 changes from a utility sewing mode to an embroidery sewing mode. Further, the X-direction feed motor 18 and Y-direction feed motor 19 are electrically connected to an output interface 36 described later provided in a control unit 30 of the embroidery sewing machine 1 via a connector 40*a*. The control unit 30 drives the X-direction feed motor 18 and Y-direction feed motor 19 independently.

Next, the thread trimmer 7 disposed in the sewing bed 2 will be described with reference to FIG. 2.

Figure 2:
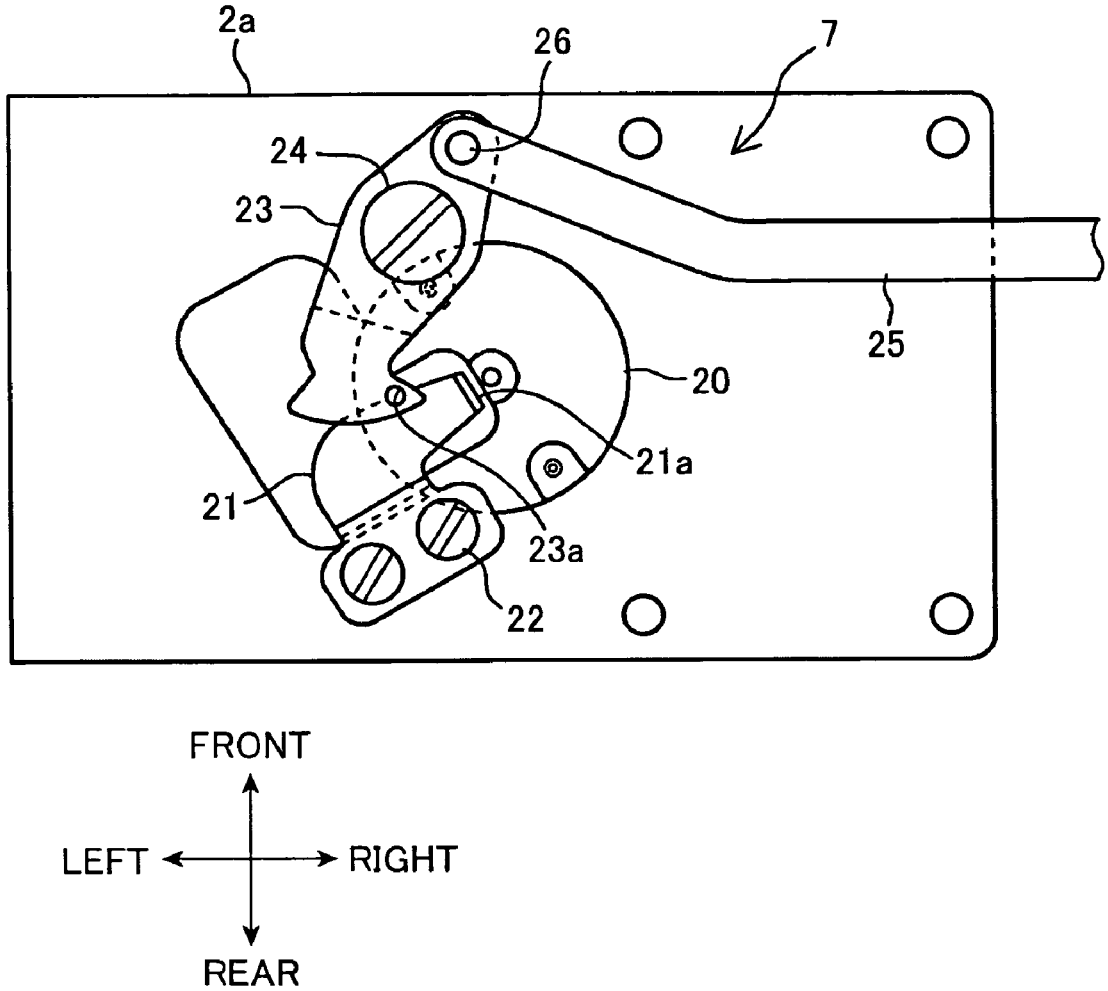
FIG. 2 is a bottom view of a thread trimmer employed in the embroidery sewing machine according to the embodiment.

As shown in FIG. 2, a circular needle hole plate 20 formed with a needle hole is fitted in substantially the center region of the needle plate 2*a*. A fixed blade member 21 that is substantially L-shaped in a plan view is fixed beneath and to the side of the circular needle hole plate 20. A free end of the fixed blade member 21 is bent downward. A fixed blade 21*a* having a predetermined width is formed on the free end of the fixed blade member 21 facing downward.

A movable blade member 23 is pivotably supported on the bottom side thereof by a step bolt 24 on the opposite side of the circular needle hole plate 20 from the fixed blade member 21. The movable blade member 23 can be pivotally moved about the step bolt 24. A movable blade 23*a* is formed near an end of the movable blade member 23.

A connecting rod 25 extends from a thread-cutting drive mechanism (not shown) to a base end (right end in FIG. 2) of the movable blade member 23. A left end of the connecting rod 25 is rotatably coupled to the base end of the movable blade member 23 by a pin 26. Hence, by moving the connecting rod 25 in a reciprocating left-and-right motion, the movable blade member 23 is pivotally moved in a cutting direction (counterclockwise direction) a predetermined angle from a standby position shown in FIG. 2 and, after moving the upper thread aside, is pivotally moved back the predetermined angle in a return direction (clockwise direction). As the movable blade member 23 is pivotally moved in the return direction, both the upper and lower threads are cut simultaneously through the cooperative operations of the movable blade 23*a* and fixed blade 21*a*.

Next, a control system of the embroidery sewing machine 1 will be described with reference to FIG. 3. As shown in FIG. 3, the control unit 30 includes an input interface 31; a computer having a CPU 32, a ROM 33, a RAM 34, and a nonvolatile flash memory 35 that can be electrically overwritten; an output interface 36; a bus 37 having data buses or the like connecting the interfaces 31 and 36 and the components of the computer; a drive circuit 38 for driving the sewing machine motor 42; a drive circuit 39 for driving the stepping motor 43 for the needle bar swinging mechanism; a drive circuit 40 for driving the stepping motor 44 for the horizontal feed dog moving mechanism; a drive circuit 41 for driving the X-direction feed motor 18 and Y-direction feed motor 19; and the like.

The start/stop switch 12, the touch keys 11 of the control panel, and the like are connected to the input interface 31. The output interface 36 is connected to the drive circuits 38 through 40 for the motors 42 through 44, a display controller (LCDC) 45 for controlling the color display 10, and the drive circuit 41 for the X-direction feed motor 18 and Y-direction feed motor 19 of the embroidery frame drive mechanism 15.

The ROM 33 stores a sewing machine control program for controlling how the various drive mechanisms are driven, for controlling the selection of utility patterns and embroidery patterns, and the like; a control program for developing embroidery data described later; a control program for controlling the sewing of embroidery data; and the like. The ROM 33 includes an embroidery data memory 33*a* that stores, by pattern numbers, sewing data for sewing various types of utility patterns and embroidery data for sewing various types of embroidery patterns.

Figure 4A:
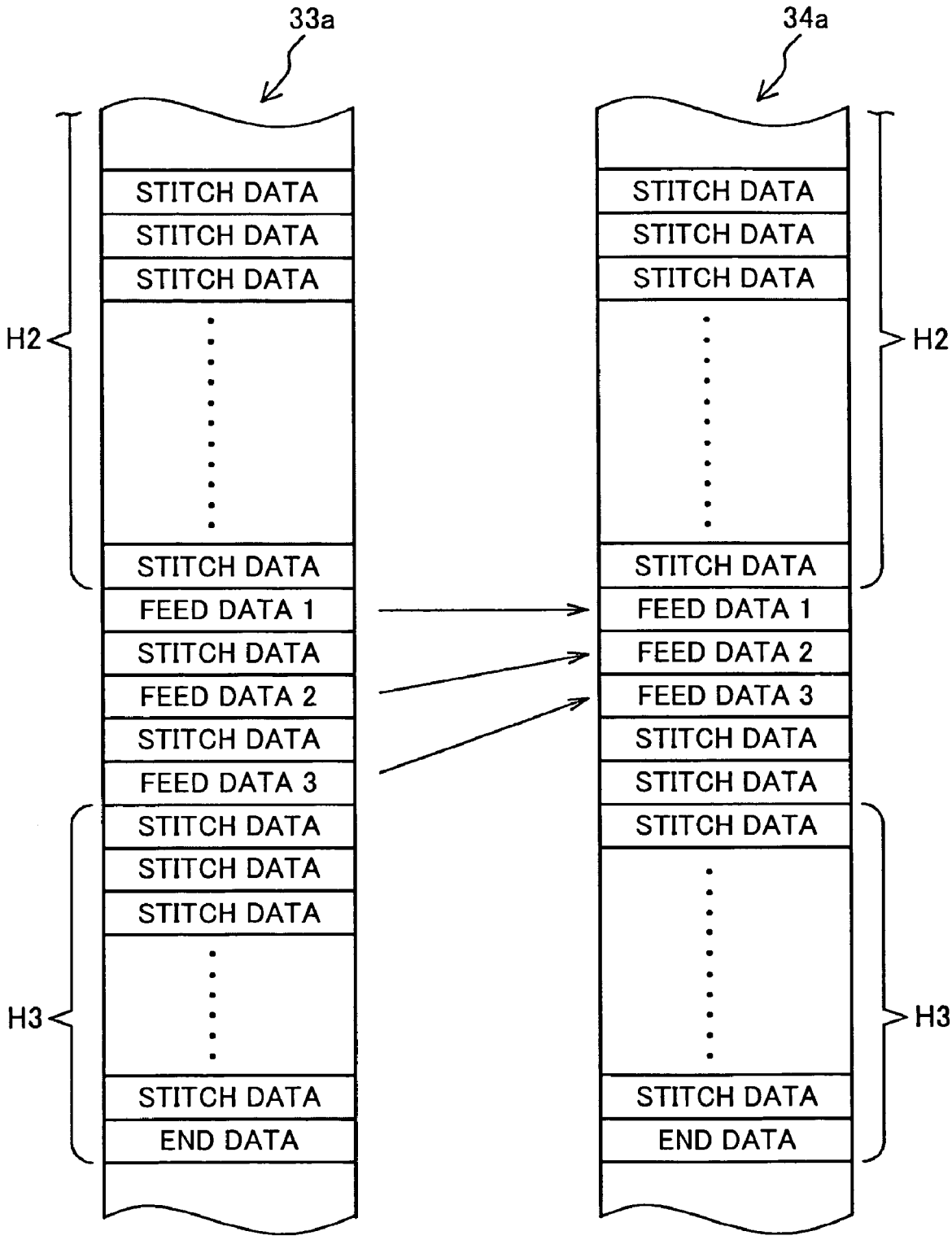
FIG. 4A is an explanatory diagram showing a portion of embroidery data stored in a section of ROM in a control unit of the embroidery sewing machine and embroidery data stored in a developing memory of RAM in the control unit.
Figure 7:
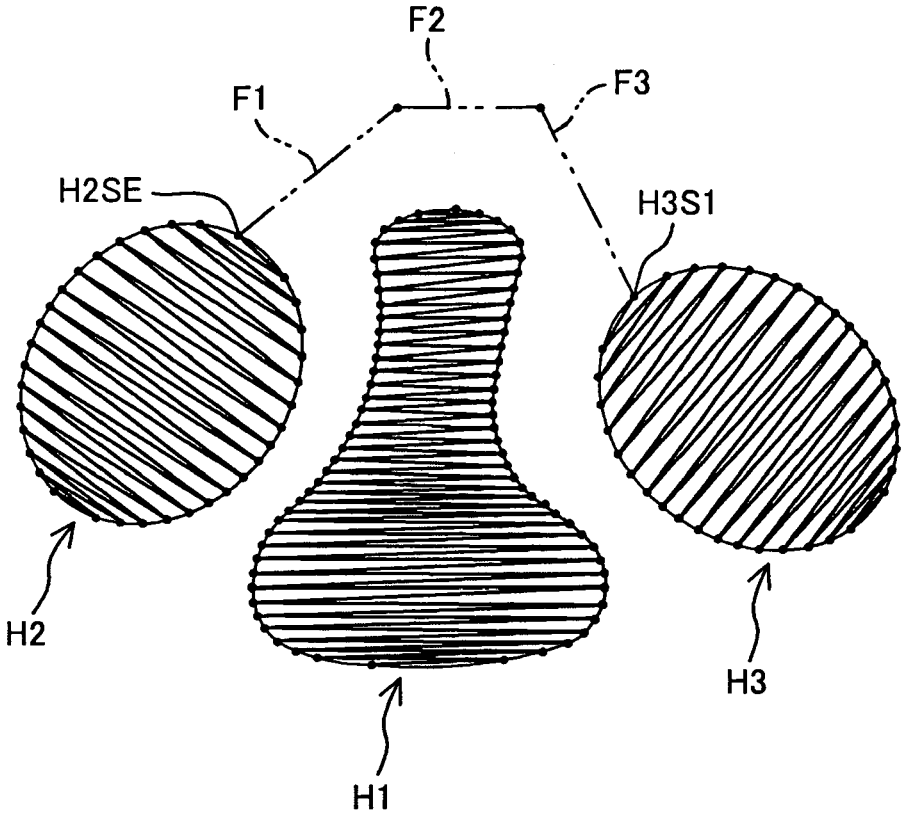
FIG. 7 is an explanatory diagram illustrating a sewing order performed based on original embroidery data.

For an embroidery pattern with three separate regions shown in FIG. 7, a plurality of stitch data and feed data are sequentially stored in the embroidery data memory 33*a* for respective embroidery regions H1 through H3. A portion of the embroidery data is shown in FIG. 4A. The embroidery data shown in FIG. 4A does not include thread cutting data, but instead includes feed data 1 through 3 located between stitch data for embroidery regions H2 and H3, for example.

The RAM 34 is provided with a developing memory 34*a* for storing developed embroidery data, various memory units for accommodating the results of calculations performed by the CPU 32, pointers, counters, and the like as needed.

Figure 4B:
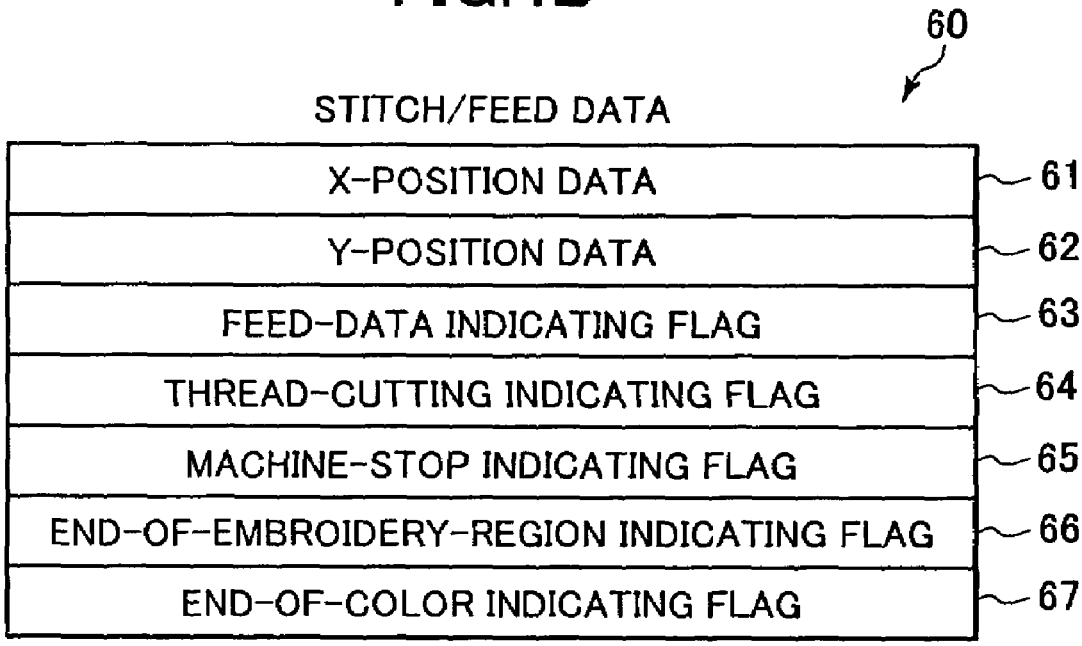
FIG. 4B is an explanatory diagram showing a data structure of stitch/feed data used by the control unit of the embroidery sewing machine according to the embodiment.

A data structure of stitch/feed data will be described with reference to FIG. 4B. As shown in FIG. 4B, stitch/feed data 60 includes X-direction data 61, Y-direction data 62, a feed-data indicating flag 63, a thread-cutting indicating flag 64, a machine-stop indicating flag 65, an end-of-embroidery-region indicating flag 66, and an end-of-color indicating flag 67. The stitch/feed data 60 is provided for each stitch.

The X-direction data 61 specifies a position in the X direction (X-coordinate). The Y-position data 62 specifies a position in the Y direction (Y-coordinate). The X-position data 61 and the Y-position data 62 specify a needle drop position when the stitch/feed data 60 is stitch data, and specify a feed executed position (feed destination position) when the stitch/feed data 60 is feed data. The feed-data indicating flag 63 (bit data) indicates whether the data is feed data. That is, the stitch/feed data 60 is feed data when the feed-data indicating flag 63 is ON, while the stitch/feed data 60 is stitch data when the feed-data indicating flag 63 is OFF. The thread-cutting indicating flag 64 (bit data) indicates whether a thread cutting operation should be performed. The machine-stop indicating flag 65 (bit data) indicates whether a stitch operation of the embroidery sewing machine 1 should be stopped. The stitch/feed data 60 is end data when the machine-stop indicating flag 65 is ON. The end-of-embroidery-region indicating flag 66 (bit data) indicates whether the data is the final data of the current embroidery region. The end-of-color indicating flag 67 (bit data) indicates whether the data is the final data of the current color of thread.

Figure 5:
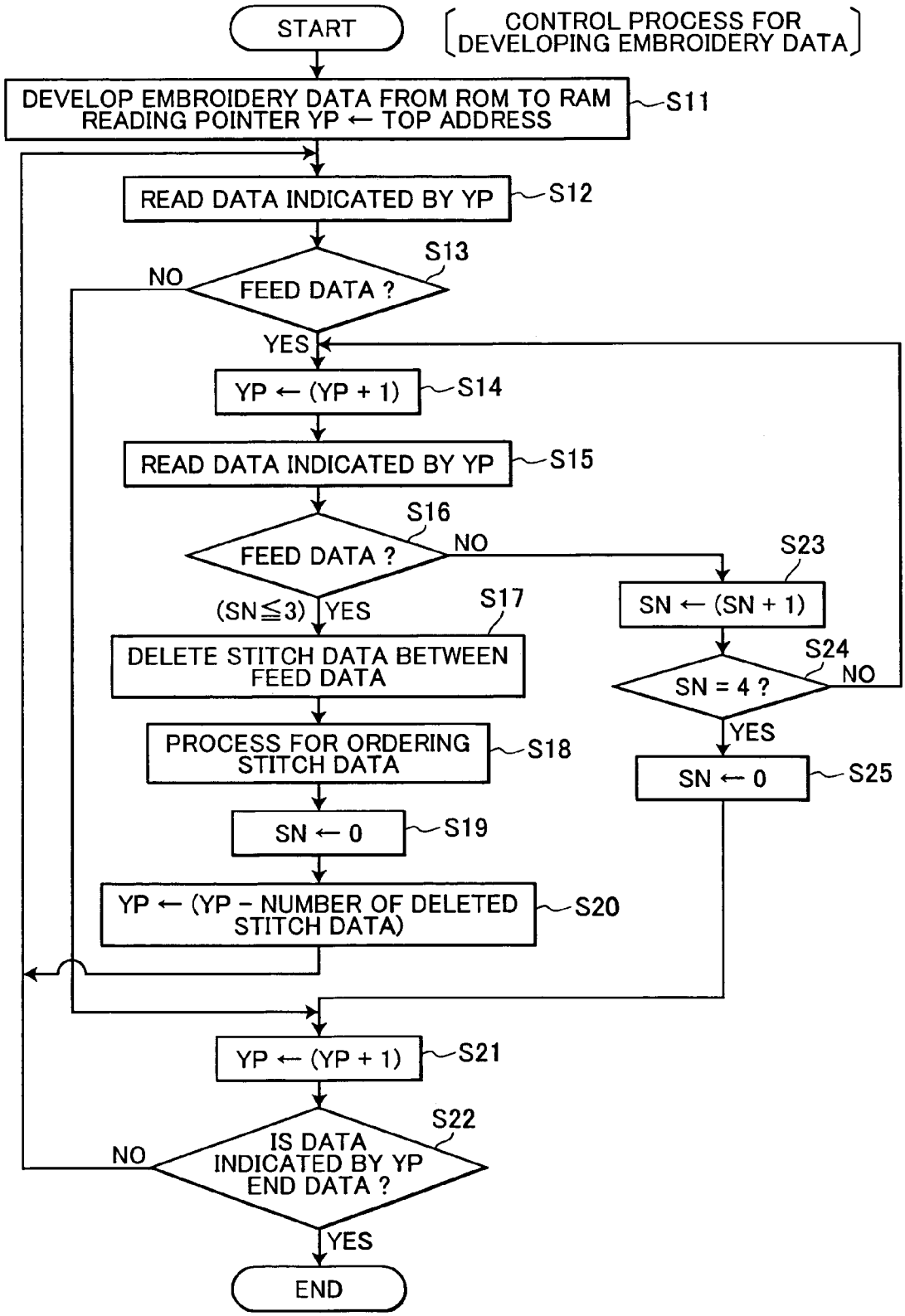
FIG. 5 is a flowchart illustrating steps in a control process for developing embroidery data executed by the control unit of the embroidery sewing machine according to the embodiment.

Next, a control process for developing embroidery data executed by the control unit 30 will be described with reference to the flowchart in FIG. 5, wherein each step in the flowchart is represented by the symbol Si (i=11, 12, 13, . . . ). The control process is executed at the beginning of a sewing operation to develop embroidery data read from the embroidery data memory 33*a* of the ROM 33 to the developing memory 34*a* of the RAM 34. The control process begins when the user selects a desired pattern from the plurality of patterns displayed on the control panel 11 and operates the start/stop switch 12.

At the beginning of the process in S11, the CPU 32 develops the embroidery data selected by the user via the control panel 11 from the embroidery data memory 33*a* of the ROM 33 to the developing memory 34*a* of the RAM 34. Then, the CPU 32 sets a reading pointer YP to a top address of the developed embroidery data. In S12 the CPU 32 reads data indicated by the reading pointer YP. In S13 the CPU 32 determines whether the data read in S12 is feed data, by checking ON/OFF of the feed-data indicating flag 63. If the data is not feed data but stitch data (S13: NO), then in S21 the CPU 32 increments the reading pointer YP. In S22 the CPU 32 determines whether the data indicated by the reading pointer YP is end data. If the data is not end data (S22: NO), then the CPU 32 returns to S12 and repeats the process described above.

However, if the data read in S12 is feed data (S13: YES), then in S14 the CPU 32 increments the reading pointer YP and in S15 reads data indicated by the reading point YP. In S16 the CPU 32 determines whether the data read in S15 is feed data. If the data is not feed data but stitch data (S16: NO), then in S23 the CPU 32 increments a counter SN for counting stitch data.

Next, the CPU 32 determines in S24 whether the counter SN has reached "4". If the counter SN is not "4" (S24: NO), then the CPU 32 returns to S14 and repeats the process described above. However, if the counter SN has reached "4" (S24: YES), indicating a high probability of an embroidery region since four stitch data exist between feed data, then in S25 the CPU 32 resets the counter SN and jumps to S21.

However, if the CPU 32 determines that the data read in S15 is feed data (S16: YES), then in S17 the CPU 32 deletes all stitch data located between the two feed data since the counter SN is smaller than "4", indicating a high probability that the stitch data between the two feed data is needle drop position data for feeding (moving) the workpiece to the next embroidery region. Next, as shown in FIG. 4A, the control unit 30 executes an ordering process in S18 to shift the data following the deleted stitch data toward the top address.

In S19 the CPU 32 resets the counter SN and in S20 sets the reading pointer YP to the address currently indicated by the reading pointer YP minus the number of deleted stitch data. Subsequently, the CPU 32 returns to S12 and repeats the process described above. The control process ends when the data indicated by the reading pointer YP is end data (S22: YES).

Next, a control process for sewing embroidery data executed after the control process for developing embroidery data will be described with reference to FIG. 6. At the beginning of the process in S31, the CPU 32 sets the reading pointer YP to the top address of the embroidery data developed in the developing memory 34*a*. In S32 the CPU 32 reads data indicated by the reading pointer YP. In S33 the CPU 32 determines whether the data read in S32 is feed data. If the data is not feed data but stitch data (S33: NO), then in S44 the CPU 32 executes a sewing process to perform a stitch.

In S45 the CPU 32 increments the reading pointer YP. In S46 the CPU 32 determines whether the data indicated by the reading pointer YP is end data. If the data is not end data (S46: NO), then the CPU 32 returns to S32 and repeats the process described above. However, if the data read in S32 is feed data (S33: YES), then in S34 the CPU 32 reads embroidery data at three addresses from the address just prior to the current address (YP-1) through the address three addresses prior to the current (YP-3). In S35 the CPU 32 determines whether the data is reinforcement stitch data, that is, whether a feed length of three stitch data is smaller than a predetermined amount. Reinforcement stitching is performed for preventing thread from unraveling when the thread is cut at that position. The feed amount can be obtained by calculating a distance between the previous stitch position and the current stitch position. If the CPU 32 determines that the data is reinforcement stitch data (S35: YES), the CPU 32 jumps to S37.

Note that, in the present embodiment, the CPU 32 determines that the data is reinforcement stitch data when the feed length of three stitch data is smaller than a predetermined amount. However, the CPU 32 may determine that the data is reinforcement stitch data when the feed length of another predetermined number (for example, two) of stitch data is smaller than a predetermined amount.

However, if the data is not reinforcement stitch data (S35: NO), then in S36 the CPU 32 inserts three needle strokes worth of prestored reinforcement stitch data and executes reinforcement stitching according to the reinforcement stitch data. In S37 the CPU 32 inserts thread cutting data and outputs the thread cutting data (thread cutting command) to the thread trimmer 7. In this way, the embroidery sewing machine 1 can execute reinforcement stitching immediately before the thread trimmer 7 executes a thread cutting operation. In S38 the CPU 32 calculates a feed length and direction from the current position based on the feed data read in S32. In other words, the CPU 32 calculates the total feed amount. Here, the meaning of the total feed amount includes feed length and feed direction from the current position.

In S39 the CPU 32 increments the reading pointer YP and in S40 reads data indicated by the reading pointer YP. If the data is feed data (S41: YES), then the CPU 32 repeats S38 through S41, thereby accumulating the total feed amount with respect to the current position for both the X-direction and Y-direction components. When the data read in S40 is no longer feed data (S41: NO), that is, when the data is the first stitch data in the next embroidery region, then in S42 the control unit 30 feeds the workpiece from an initial feed start position (H2SE in FIG. 8) to a final feed executed position (H3S1 in FIG. 8) using the shortest distance from the current position based on the total feed amount. In other words, when a plurality of consecutive feed data (feed data 1 through 3 in the developing memory 34*a* of FIG. 4A) is extracted in processing of S38 through S41, in S42 the CPU 32 controls the embroidery frame drive mechanism 15 to move the embroidery frame (i.e., workpiece) from the initial feed start position (H2SE) indicated by the feed data 1 directly to the final feed executed position (H3S1) indicated by the feed data 3.

In S43 the CPU 32 performs reinforcement stitching for beginning sewing of the next embroidery region. That is, the CPU 32 adds reinforcement stitch data to the embroidery data for performing reinforcement stitching immediately after the workpiece is fed in S42. Next, the CPU 32 executes S44 through S46 described above. The control process ends when the data indicated by the reading pointer YP is end data (S46: YES).

As an example, the control unit 30 first sews the embroidery region H1 shown in FIG. 7 and subsequently sews the embroidery region H2 based on the original embroidery data shown on the left side of FIG. 4A (stored in the ROM 33). After performing the feed operations according to the three feed data 1 through 3, the control unit 30 sews the final embroidery region H3. In this example, the two stitch data between the feed data 1 through 3 have been deleted in advance (S17).

Subsequently, an ordering operation is performed to fill the addresses vacated by the deleted stitch data with the feed data by shifting the feed data toward the top address (S18). The modified data is stored in the developing memory 34*a*, as shown on the right side of FIG. 4A, wherein the three feed data 1 through 3 remain intact.

Figure 8:
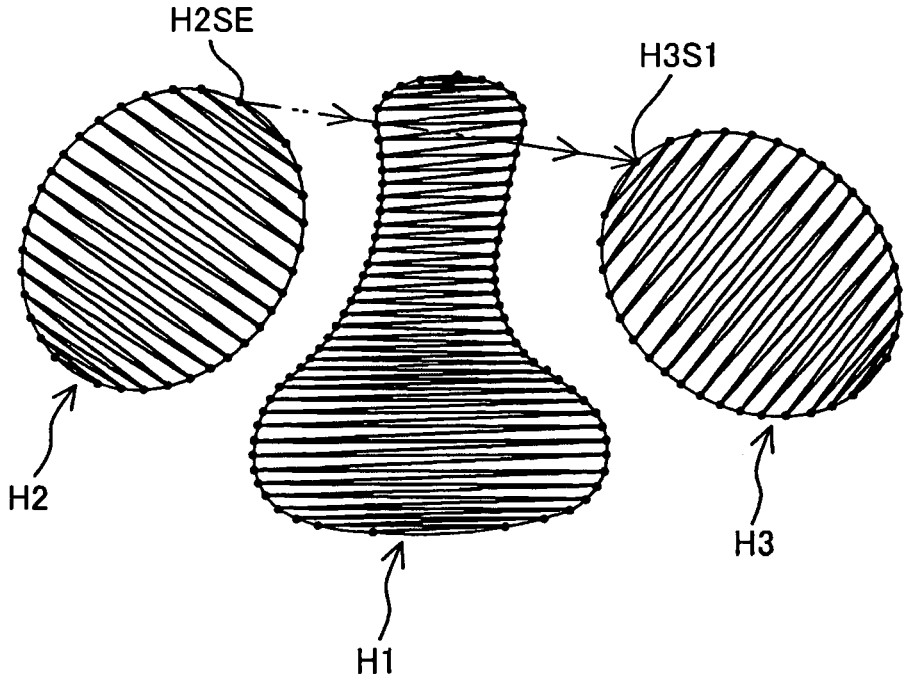
FIG. 8 is an explanatory diagram illustrating embroidery sewing in a sewing operation according to the embodiment of the present disclosure.

If a series of feed data is detected immediately after sewing the embroidery region H2, and reinforcement stitch data is not included, reinforcement stitching is forcibly executed (S36), and the thread is subsequently cut (S37). Next, as shown in FIG. 8, the workpiece is directly fed from the initial feed start position H2SE to the final feed executed position H3S1 based on the three feed data 1 through 3 (S42). Then reinforcement stitching is executed (S43) and the embroidery region H3 is sewn (S44).

As described above, during an embroidery process, the control unit 30 of the embroidery sewing machine 1 adds thread cutting and reinforcement stitching at positions to which the workpiece is fed according to feed data when using data that does not include thread cutting data. The control unit 30 can also perform reinforcement stitching at starting positions for sewing after the workpiece has been fed according to the feed data, thereby making effective use of embroidery data that does not include thread cutting data and increasing the efficiency of sewing operations.

When the feed data 1 for feeding the workpiece is detected upon the completion of an embroidery region based on the embroidery data read from the embroidery data memory 33*a* of the ROM 33, the thread trimmer 7 executes a thread cutting operation, even when thread cutting data does not exist immediately before the feed data 1. Therefore, if jump stitches are stipulated by one or a plurality of feed data, the embroidery sewing machine 1 can reliably prevent the generation of the jump stitches by cutting the thread without editing any of the embroidery data and can improve the efficiency of sewing operations by eliminating the need to remove such jump stitches.

As described above, the embroidery sewing machine 1 performs reinforcement stitching immediately before a thread cutting operation by the thread trimmer 7 and performs reinforcement stitching immediately after feeding the workpiece based on consecutive feed data 1 through 3. Thus, the embroidery sewing machine 1 can reliably prevent the unraveling of embroidery thread by reinforcement stitching at an end position when cutting thread immediately before feeding the workpiece. Moreover, the embroidery sewing machine 1 can reliably prevent the unraveling of embroidery thread by reinforcement stitching at the start position for sewing immediately after feeding the workpiece.

Further, when a plurality of consecutive feed data 1 through 3 are extracted, the embroidery sewing machine 1 directly feeds the workpiece from the initial feed start position based on the first feed data 1 to the final feed executed position based on the last feed data 3. In this way, the embroidery sewing machine 1 can avoid excess feeding required to circumvent an existing embroidery region by feeding the workpiece the shortest distance possible, thereby speeding up the sewing operation.

While the disclosure has been described in detail with reference to the specific embodiment thereof, it would be apparent to those skilled in the art that various changes and modifications may be made therein without departing from the spirit of the disclosure.

(1) For example, the step of calculating the total feed amount executed in S38 of the control process for sewing embroidery data (FIG. 6) may instead be executed in the control process for developing embroidery data (FIG. 5), and the plurality of feed data may be combined together and stored as a single feed data in the embroidery data.

Figure 6:
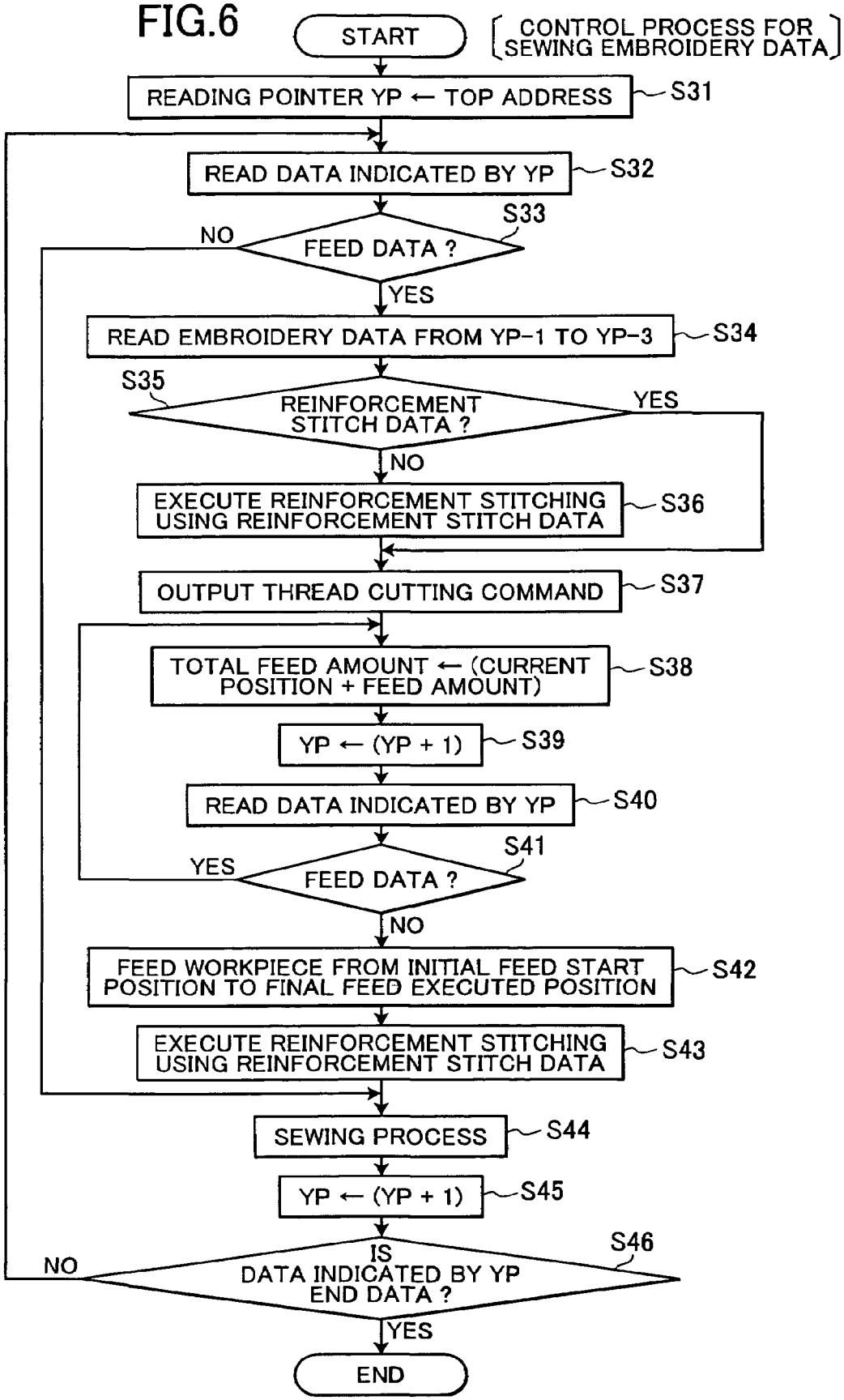
FIG. 6 is a flowchart illustrating steps in a control process for sewing embroidery data executed by the control unit of the embroidery sewing machine according to the embodiment.

(2) The processes for detecting feed data (S13 and S16) and deleting stitch data interposed between the plurality of feed data 1 through 3 (S17) performed in the control process for developing embroidery data (FIG. 5) may instead be executed during the process for sewing embroidery data (FIG. 6). For example, the processing of S11 through S25 in FIG. 5 may be executed between S37 and S38 in FIG. 6.

(3) In the embroidery sewing machine 1 according to the above-described embodiment, the embroidery data having a combination of switch data and feed data but including no thread cutting data or reinforcement stitch data is stored in the internal ROM 33. However, the embroidery data may instead be stored in an external storage medium such as a ROM card or flexible disk that can be inserted in the embroidery sewing machine 1.

(4) In the embroidery sewing machine 1 according to the above-described embodiment, embroidery data includes stitch data and feed data. However, the embroidery data may include feed stitch data instead of the feed data, wherein the feed stitch data is a kind of stitch data and its stitch length is greater than a predetermined length, such as 12.8 mm. On the other hand, stitch-forming stitch data is defined as stitch data having a stitch length shorter than or equal to the predetermined length. The stitch-forming stitch data is stitch data used for forming stitches. In this modification, the control process for developing embroidery data (FIG. 5) and the control process for sewing embroidery data (FIG. 6) can be executed by using the feed stitch data instead of the feed data and by using the stitch-forming stitch data instead of the stitch data. For example, the CPU 32 extracts feed stitch data (instead of feed data) and delete unnecessary stitch data (stitch-forming stitch data) that is located between the feed stitch data and that is not used for forming stitches. Also, the CPU 32 performs thread cutting and reinforcement stitching at the end of each embroidery region according to the control process for sewing embroidery data.

Figure 9:
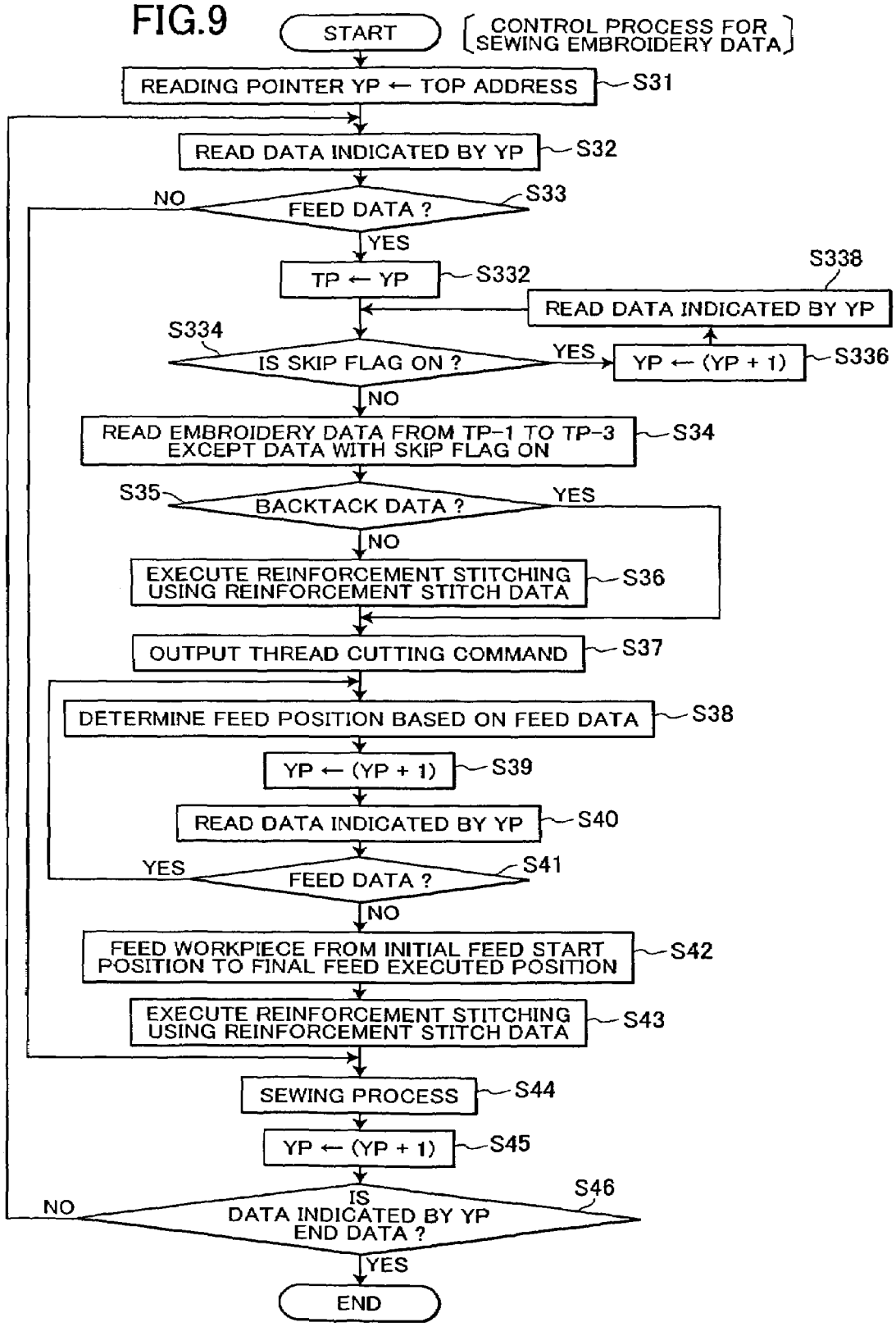
FIG. 9 is a flowchart illustrating steps in a control process for sewing embroidery data executed by a control unit of an embroidery sewing machine according to a modification.

(5) In the embroidery sewing machine 1 according to the above-described embodiment, in S17 (FIG. 5) the CPU 32 deletes all stitch data located between a plurality of feed data. However, in S17 the CPU 32 may set skip flags to the stitch data located between the plurality of feed data and to the feed data prior to the stitch data. In other words, the CPU 32 nullifies (disables) all stitch data located between the plurality of feed data when the CPU 32 determines that the number of stitch data is less than a predetermined number (four in the present modification) in the control process for developing embroidery data (FIG. 5). Taking the embroidery data shown in FIG. 4A as an example, the CPU 32 sets skip flags to the feed data 1, the stitch data after the feed data 1, the feed data 2, and the stitch data after the feed data 2. In this case, the CPU 32 continues skipping (not reading) data when the skip flag is ON. This modification is described more specifically with reference to FIG. 9. After S33, in S332 the CPU 32 sets a reinforcement stitch pointer TP to the reading pointer YP. In S334, the CPU 32 determines whether the skip flag of the data indicated by the reading pointer YP is ON. If the skip flag is ON (S334: YES), in S336 the CPU 32 increments the reading pointer YP. In S338 the CPU 32 reads data indicated by the reading pointer YP, and repeats processing of S334. If the skip flag is OFF (S334: NO), in S34' the CPU 32 reads embroidery data indicated by reinforcement stitch pointers TP-1 through TP-3 except data with the skip flag ON. In other words, the CPU 32 reads the embroidery data only when the skip flag is OFF. In S38' the CPU 32 determines a feed executed position based on the feed data that was finally read in S338 (the feed data 3 in the example shown in FIG. 4A). The feed executed position can be determined because the feed data includes the feed executed position (feed destination) indicated by the X-position data 61 and the Y-position data 62 (FIG. 4B).

What is claimed is:

1. A control unit for controlling an embroidery sewing machine including a sewing portion, a workpiece feeding portion, and a thread cutting portion, the control unit comprising:

an embroidery-data storing portion that stores embroidery data defining an embroidery pattern sewn by the sewing portion and the workpiece feeding portion, the embroidery data including stitch data indicating needle drop positions for forming stitches on a workpiece and feed data indicating feed positions for feeding the workpiece, the feed data being located between a plurality of groups of embroidery data, each of the plurality of groups of embroidery data being a group of data for performing embroidery sewing in a corresponding one of a plurality of embroidery regions, the feed data being data for connecting the plurality of embroidery regions;

a feed-data extracting portion that extracts the feed data from the embroidery data read from the embroidery-data storing portion; and a thread-cutting-data adding portion that adds thread cutting data immediately prior to the feed data extracted by the feed-data extracting portion, the thread cutting data instructing the thread cutting portion to perform thread cutting.

2. The control unit according to claim 1, wherein the feed-data extracting portion determines whether the feed data exists in the embroidery data, after the sewing portion completes embroidery sewing of each embroidery region.

3. The control unit according to claim 1, further comprising a reinforcement-stitch-data adding portion that adds reinforcement stitch data instructing the sewing portion to perform reinforcement stitching at least one of two times including immediately before the thread cutting portion performs thread cutting based on the thread cutting data added by the thread-cutting-data adding portion and immediately after the workpiece feeding portion feeds the workpiece based on the feed data extracted by the feed-data extracting portion.

4. The control unit according to claim 1, further comprising:

a counting portion that, when the feed-data extracting portion extracts a plurality of feed data from the embroidery data, counts a number of stitch data located between the plurality of feed data;

a determining portion that determines whether the number of stitch data counted by the counting portion is less than a predetermined number; and a deleting portion that deletes all stitch data located between the plurality of feed data from the embroidery data when the determining portion determines that the number of stitch data is less than the predetermined number.

5. The control unit according to claim 1, further comprising:

a counting portion that, when the feed-data extracting portion extracts a plurality of feed data from the embroidery data, counts a number of stitch data located between the plurality of feed data;

a determining portion that determines whether the number of stitch data counted by the counting portion is less than a predetermined number; and a nullifying portion that nullifies all stitch data located between the plurality of feed data when the determining portion determines that the number of stitch data is less than the predetermined number.

6. The control unit according to claim 1, further comprising a feed controlling portion that, when the feed-data extracting portion extracts a plurality of consecutive feed data including an initial feed data and a final feed data, controls the workpiece feeding portion to feed the workpiece from an initial feed start position indicated by the initial feed data directly to a final feed executed position indicated by the final feed data.

7. A control unit for controlling an embroidery sewing machine including a sewing portion, a workpiece feeding portion, and a thread cutting portion, the control unit comprising:

an embroidery-data storing portion that stores embroidery data defining an embroidery pattern sewn by the sewing portion and the workpiece feeding portion, the embroidery data including stitch data indicating needle drop positions for forming stitches on a workpiece, the stitch data including feed stitch data having a stitch length longer than a predetermined length and including stitch-forming stitch data having a stitch length shorter than or equal to the predetermined length;

a feed-stitch-data extracting portion that extracts the feed stitch data from the embroidery data read from the embroidery-data storing portion; and a thread-cutting-data adding portion that adds thread cutting data immediately prior to the feed stitch data extracted by the feed-stitch-data extracting portion, the thread cutting data instructing the thread cutting portion to perform thread cutting.

8. The control unit according to claim 7, wherein the embroidery data includes a plurality of groups of embroidery data for performing embroidery sewing in a plurality of embroidery regions; and wherein the feed-stitch-data extracting portion determines whether the feed stitch data exists in the embroidery data, after the sewing portion completes embroidery sewing of each embroidery region.

9. The control unit according to claim 7, further comprising a reinforcement-stitch-data adding portion that adds reinforcement stitch data instructing the sewing portion to perform reinforcement stitching at least one of two times including immediately before the thread cutting portion performs thread cutting based on the thread cutting data added by the thread-cutting-data adding portion and immediately after the workpiece feeding portion feeds the workpiece based on the feed stitch data extracted by the feed-stitch-data extracting portion.

10. The control unit according to claim 7, further comprising:

a counting portion that, when the feed-stitch-data extracting portion extracts a plurality of feed stitch data from the embroidery data, counts a number of stitch-forming stitch data located between the plurality of feed stitch data;

a determining portion that determines whether the number of stitch-forming stitch data counted by the counting portion is less than a predetermined number; and a deleting portion that deletes all stitch-forming stitch data located between the plurality of feed stitch data from the embroidery data when the determining portion determines that the number of stitch-forming stitch data is less than the predetermined number.

11. The control unit according to claim 7, further comprising:

a counting portion that, when the feed-stitch-data extracting portion extracts a plurality of feed stitch data from the embroidery data, counts a number of stitch-forming stitch data located between the plurality of feed stitch data;

a determining portion that determines whether the number of stitch-forming stitch data counted by the counting portion is less than a predetermined number; and a nullifying portion that nullifies all stitch-forming stitch data located between the plurality of feed stitch data when the determining portion determines that the number of stitch-forming stitch data is less than the predetermined number.

12. The control unit according to claim 7, further comprising a feed controlling portion that, when the feed-stitch-data extracting portion extracts a plurality of consecutive feed stitch data including an initial feed stitch data and a final feed stitch data, controls the workpiece feeding portion to feed the workpiece from an initial feed start position indicated by the initial feed stitch data directly to a final feed executed position indicated by the final feed stitch data.

13. A control unit for controlling an embroidery sewing machine including a sewing portion, a workpiece feeding portion, and a thread cutting portion, the control unit comprising:

a memory that stores embroidery data defining an embroidery pattern sewn by the sewing portion and the workpiece feeding portion, the embroidery data including stitch data indicating needle drop positions for forming stitches on a workpiece and feed data indicating feed positions for feeding the workpiece, the feed data being located between a plurality of groups of embroidery data, each of the plurality of groups of embroidery data being a group of data for performing embroidery sewing in a corresponding one of a plurality of embroidery regions, the feed data being data for connecting the plurality of embroidery regions; and a controller that extracts the feed data from the embroidery data read from the memory, and that adds thread cutting data immediately prior to the feed data, the thread cutting data instructing the thread cutting portion to perform thread cutting.

14. The control unit according to claim 13, wherein the controller determines whether the feed data exists in the embroidery data, after the sewing portion completes embroidery sewing of each embroidery region.

15. The control unit according to claim 13, wherein the controller adds reinforcement stitch data instructing the sewing portion to perform reinforcement stitching at least one of two times including immediately before the thread cutting portion performs thread cutting based on the thread cutting data and immediately after the workpiece feeding portion feeds the workpiece based on the feed data.

16. The control unit according to claim 13, wherein the controller counts, when a plurality of feed data is extracted from the embroidery data, a number of stitch data located between the plurality of feed data, determines whether the number of stitch data is less than a predetermined number, and deletes all stitch data located between the plurality of feed data from the embroidery data when the controller determines that the number of stitch data is less than the predetermined number.

17. The control unit according to claim 13, wherein the controller counts, when a plurality of feed data is extracted from the embroidery data, a number of stitch data located between the plurality of feed data, determines whether the number of stitch data is less than a predetermined number, and nullifies all stitch data located between the plurality of feed data when the controller determines that the number of stitch data is less than the predetermined number.

18. The control unit according to claim 13, wherein, when the controller extracts a plurality of consecutive feed data including an initial feed data and a final feed data, the controller controls the workpiece feeding portion to feed the workpiece from an initial feed start position indicated by the initial feed data directly to a final feed executed position indicated by the final feed data.

19. A control unit for controlling an embroidery sewing machine including a sewing portion, a workpiece feeding portion, and a thread cutting portion, the control unit comprising:

a memory that stores embroidery data defining an embroidery pattern sewn by the sewing portion and the workpiece feeding portion, the embroidery data including stitch data indicating needle drop positions for forming stitches on a workpiece, the stitch data including feed stitch data having a stitch length longer than a predetermined length and including stitch-forming stitch data having a stitch length shorter than or equal to the predetermined length; and a controller that extracts the feed stitch data from the embroidery data read from the memory, and that adds thread cutting data immediately prior to the feed stitch data, the thread cutting data instructing the thread cutting portion to perform thread cutting.

20. The control unit according to claim 19, wherein the embroidery data includes a plurality of groups of embroidery data for performing embroidery sewing in a plurality of embroidery regions; and wherein the controller determines whether the feed stitch data exists in the embroidery data, after the sewing portion completes embroidery sewing of each embroidery region.

21. The control unit according to claim 19, wherein the controller adds reinforcement stitch data instructing the sewing portion to perform reinforcement stitching at least one of two times including immediately before the thread cutting portion performs thread cutting based on the thread cutting data and immediately after the workpiece feeding portion feeds the workpiece based on the feed stitch data.

22. The control unit according to claim 19, wherein the controller counts, when a plurality of feed stitch data is extracted from the embroidery data, a number of stitch-forming stitch data located between the plurality of feed stitch data, determines whether the number of stitch-forming stitch data is less than a predetermined number, and deletes all stitch-forming stitch data located between the plurality of feed stitch data from the embroidery data when the controller determines that the number of stitch-forming stitch data is less than the predetermined number.

23. The control unit according to claim 19, wherein the controller counts, when the controller extracts a plurality of feed stitch data from the embroidery data, a number of stitch-forming stitch data located between the plurality of feed stitch data, determines whether the number of stitch-forming stitch data is less than a predetermined number, and nullifies all stitch-forming stitch data located between the plurality of feed stitch data when the controller determines that the number of stitch-forming stitch data is less than the predetermined number.

24. The control unit according to claim 19, wherein, when the controller extracts a plurality of consecutive feed stitch data including an initial feed stitch data and a final feed stitch data, the controller controls the workpiece feeding portion to feed the workpiece from an initial feed start position indicated by the initial feed stitch data directly to a final feed executed position indicated by the final feed stitch data.

25. A method for controlling an embroidery sewing machine including a sewing portion, a workpiece feeding portion, a thread cutting portion, and a memory that stores embroidery data including stitch data and feed data, the method comprising:

extracting the feed data from the embroidery data read from the memory, the embroidery data defining an embroidery pattern sewn by the sewing portion and the workpiece feeding portion, the stitch data indicating needle drop positions for forming stitches on a workpiece, the feed data indicating feed positions for feeding the workpiece, the feed data being located between a plurality of groups of embroidery data, each of the plurality of groups of embroidery data being a group of data for performing embroidery sewing in a corresponding one of a plurality of embroidery regions, the feed data being data for connecting the plurality of embroidery regions; and adding thread cutting data immediately prior to the feed data extracted in the feed-data extracting step, the thread cutting data instructing the thread cutting portion to perform thread cutting.

26. The method according to claim 25, wherein the feed-data extracting step includes determining whether the feed data exists in the embroidery data, after the sewing portion completes embroidery sewing of each embroidery region.

27. The method according to claim 25, further comprising adding reinforcement stitch data instructing the sewing portion to perform reinforcement stitching at least one of two times including immediately before the thread cutting portion performs thread cutting based on the thread cutting data added in the thread-cutting-data adding step and immediately after the workpiece feeding portion feeds the workpiece based on the feed data extracted in the feed-data extracting step.

28. The method according to claim 25, further comprising:

counting, when a plurality of feed data is extracted from the embroidery data in the feed-data extracting step, a number of stitch data located between the plurality of feed data;

determining whether the number of stitch data counted in the counting step is less than a predetermined number; and deleting all stitch data located between the plurality of feed data from the embroidery data when the number of stitch data is determined to be less than the predetermined number in the determining step.

29. The method according to claim 25, further comprising:

counting, when a plurality of feed data is extracted from the embroidery data in the feed-data extracting step, a number of stitch data located between the plurality of feed data;

determining whether the number of stitch data counted in the counting step is less than a predetermined number; and nullifying all stitch data located between the plurality of feed data when the number of stitch data is determined to be less than the predetermined number in the determining step.

30. The method according to claim 25, further comprising controlling, when a plurality of consecutive feed data including an initial feed data and a final feed data is extracted in the feed-data extracting step, the workpiece feeding portion to feed the workpiece from an initial feed start position indicated by the initial feed data directly to a final feed executed position indicated by the final feed data.

31. A method for controlling an embroidery sewing machine including a sewing portion, a workpiece feeding portion, a thread cutting portion, and a memory that stores embroidery data including stitch data, the stitch data including feed stitch data and stitch-forming stitch data, the method comprising:

extracting the feed stitch data from the embroidery data read from the memory, the embroidery data defining an embroidery pattern sewn by the sewing portion and the workpiece feeding portion, the stitch data indicating needle drop positions for forming stitches on a workpiece, the feed stitch data having a stitch length longer than a predetermined length, the stitch-forming stitch data having a stitch length shorter than or equal to the predetermined length; and adding thread cutting data immediately prior to the feed stitch data extracted in the feed-stitch-data extracting step, the thread cutting data instructing the thread cutting portion to perform thread cutting.

32. The method according to claim 31, wherein the embroidery data includes a plurality of groups of embroidery data for performing embroidery sewing in a plurality of embroidery regions; and wherein the feed-stitch-data extracting step includes determining whether the feed stitch data exists in the embroidery data, after the sewing portion completes embroidery sewing of each embroidery region.

33. The method according to claim 31, further comprising adding reinforcement stitch data instructing the sewing portion to perform reinforcement stitching at least one of two times including immediately before the thread cutting portion performs thread cutting based on the thread cutting data added in the thread-cutting-data adding step and immediately after the workpiece feeding portion feeds the workpiece based on the feed stitch data extracted in the feed-stitch-data extracting step.

34. The method according to claim 31, further comprising:

counting, when a plurality of feed stitch data is extracted from the embroidery data in the feed-stitch-data extracting step, a number of stitch-forming stitch data located between the plurality of feed stitch data;

determining whether the number of stitch-forming stitch data counted in the counting step is less than a predetermined number; and deleting all stitch-forming stitch data located between the plurality of feed stitch data from the embroidery data when the number of stitch-forming stitch data is determined to be less than the predetermined number in the determining step.

35. The method according to claim 31, further comprising:

counting, when a plurality of feed stitch data is extracted from the embroidery data in the feed-stitch-data extracting step, a number of stitch-forming stitch data located between the plurality of feed stitch data;

determining whether the number of stitch-forming stitch data counted in the counting step is less than a predetermined number; and nullifying all stitch-forming stitch data located between the plurality of feed stitch data when the number of stitch-forming stitch data is determined to be less than the predetermined number in the determining step.

36. The method according to claim 31, further comprising controlling, when a plurality of consecutive feed stitch data including an initial feed stitch data and a final feed stitch data is extracted in the feed-stitch-data extracting step, the workpiece feeding portion to feed the workpiece from an initial feed start position indicated by the initial feed stitch data directly to a final feed executed position indicated by the final feed stitch data.

* * * * *